US008465125B2

(12) United States Patent
Tsubaki et al.

(10) Patent No.: US 8,465,125 B2
(45) Date of Patent: Jun. 18, 2013

(54) IMAGE FORMING APPARATUS WITH A STRUCTURE FOR PREVENTING BUBBLES FROM ENTERING RECORDING HEAD OR REMAINING IN A FLUID SUPPLY CHANNEL

(75) Inventors: Kengo Tsubaki, Miyagi (JP); Tatsuro Watanabe, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 314 days.

(21) Appl. No.: 12/851,155

(22) Filed: Aug. 5, 2010

(65) Prior Publication Data

US 2011/0050814 A1 Mar. 3, 2011

(30) Foreign Application Priority Data

Aug. 27, 2009 (JP) ..... 2009-197446
Sep. 7, 2009 (JP) ..... 2009-206305

(51) Int. Cl.
*B41J 2/19* (2006.01)
*B41J 2/17* (2006.01)

(52) U.S. Cl.
USPC ..... 347/40; 347/92; 347/94

(58) Field of Classification Search
USPC ..... 347/42, 49
See application file for complete search history.

(56) References Cited

U.S. PATENT DOCUMENTS 5,565,900 A * 10/1996 Cowger et al. ..... 347/42
6,250,738 B1 * 6/2001 Waller et al. ..... 347/42
2002/0015083 A1 * 2/2002 Thorpe et al. ..... 347/85
2005/0062818 A1 * 3/2005 Hashi et al. ..... 347/92
2006/0152560 A1 * 7/2006 Samii et al. ..... 347/85
2009/0169222 A1 7/2009 Watanabe

FOREIGN PATENT DOCUMENTS

JP 54160240 A * 12/1979
JP 10-315497 2/1998
JP 10-329330 12/1998
JP 2002144576 A * 5/2002
JP 2003-19811 1/2003
JP 2003-19816 1/2003
JP 2005-59491 3/2005
JP 2005-96208 4/2005
JP 2006-281532 10/2006
JP 2006281532 A * 10/2006
JP 2007-136760 6/2007
JP 2007-245484 9/2007
JP 2008-143081 6/2008

(Continued)

OTHER PUBLICATIONS

English translation of JP 2002-144576A to Yamane et al., "Liquid Jet Head and Liquid Jet Device," 38 pp.*

(Continued)

*Primary Examiner* — Shelby Fidler
(74) *Attorney, Agent, or Firm* — Cooper & Dunham LLP

(57) ABSTRACT

An image forming apparatus includes plural heads each having a nozzle configured to discharge a droplet of a recording fluid; a distributing member to which the plural heads are attached, the distributing member having an inlet portion, a supply channel portion, and a common fluid chamber communicated with the inlet portion and configured to supply the recording fluid to the plural heads; and a fluid containing unit configured to supply the recording fluid to the distributing member via the inlet portion and the supply channel portion. The distributing member includes a flow-directing wall disposed between the supply channel portion and the common fluid chamber.

9 Claims, 17 Drawing Sheets

FOREIGN PATENT DOCUMENTS

| | | |
|---|---|---|
| JP | 4154979 | 7/2008 |
| JP | 2008-183746 | 8/2008 |
| JP | 2009-12452 | 1/2009 |
| JP | 2009-51149 | 3/2009 |
| JP | 2009-66781 | 4/2009 |
| WO | WO 2004/082945 | 9/2004 |

OTHER PUBLICATIONS

Machine generated English translation of JP2006-281532A to Masuda et al., "Inkjet Printing Apparatus," generated via http://www19.ipdl.inpit.go.jp/PA1/cgi-bin/PA1INDEX on Nov. 30, 2012; 6 pp.*

* cited by examiner

IMAGE FORMING APPARATUS WITH A STRUCTURE FOR PREVENTING BUBBLES FROM ENTERING RECORDING HEAD OR REMAINING IN A FLUID SUPPLY CHANNEL

BACKGROUND OF THE INVENTION

1. Field of the Invention

The present invention generally relates to image forming apparatuses having a structure for preventing bubbles from entering a recording head or remaining in a fluid supply channel.

2. Description of the Related Art

There are various types of image forming apparatuses, such as printers, facsimile machines, copy machines, plotters, and multifunction peripherals incorporating multiple image forming functions. For example, an inkjet recording apparatus is a fluid-discharging type printer that discharges droplets of ink using a recording head. The discharged droplets of ink attach onto a recording medium, such as a sheet of paper, an OHP sheet, or any other material onto which ink droplets or other fluid can be caused to attach in order to form, print, record, or transfer an image on the recording medium. The image forming apparatus of the fluid-discharging type includes a serial type and a line type. In the serial type, the recording head is moved in a main-scan direction as it discharges ink droplets. In the line type, the recording head discharges ink droplets without moving.

The recording medium on which an image is formed by the image forming apparatus of the fluid-discharge type may include various materials, such as paper, threads, fibers, cloth, leather, metal, plastics, glass, wood, and ceramics. The "image" printed, formed, recorded, or transferred, for example, onto the recording medium may include not only meaningful characters or figures but also random or apparently meaningless shapes or patterns. The "ink" may include a recording fluid, a fixing-treatment fluid, a DNA sample, a resist fluid, or any other fluid capable of forming an image on the recording medium.

A line-type image forming apparatus (such as an inkjet recording apparatus) is known that includes a recording head unit comprising an arrangement of plural heads, and an ink supply system capable of handling deaerated ink and having a main ink tank and a hermetically sealed sub-tank. The sub-tank may be formed of a flexible member (such as a flexible film) and capable of containing ink supplied from the main tank and also supplying the ink to the recording head. The image forming apparatus may further include a distributing member (distributor tank) for supplying (distributing) ink to the respective heads of the recording head unit, and a mechanism for ejecting bubbles collected in the distributor tank via an ink supply channel.

A discharge nozzle of the recording head of such an image forming apparatus is very fine (such as 24 μm in diameter), and oxygen may collect gradually in the nozzle if the ink contains a large amount of dissolved oxygen, possibly causing an ink discharge failure. If there are bubbles of air in the ink in the ink supply channel including the distributing member, bubbles may be supplied to the heads, or a required amount of ink may not be discharged out of the heads due to the high level of dissolved oxygen in the ink, thus failing to obtain desired discharge characteristics. Thus, there is a need for a mechanism for ejecting or removing such bubbles of air from the ink supplied to the distributing member.

Patent Document 1 discloses that a plurality of bubble flow-regulating channels are provided in an ink distributor in order to guide the bubbles to a bubble-collecting space in the distributor, wherein the ink level of the bubbles collected via the bubble flow-regulating channels is detected by float switches. Patent Document 2 discloses that a buffer tank is provided between an ink circulating channel on the printer end and a manifold, so that the ink is once collected in the buffer tank and then supplied to the manifold. Patent Document 3 discloses that a bubble capturing unit is provided to catch bubbles in a fluid supply channel between a main tank and a sub-tank. The bubble catching unit includes a fluid channel portion that is partly made of a flexible material, an actuator, and a valve. The fluid channel portion has a fluid inlet end disposed at a water-head position higher than a fluid outlet end. The bubbles in the fluid that flows through the fluid supply fluid channel are captured and then ejected by opening the valve while the fluid channel portion is contracted by the actuator.

Patent Document 4 discloses a branch member (distributing member) having fluid channels wherein ink in the fluid channels is supplied at the bottom. The branch member has an inclined ceiling and an opening channel at the highest portion of the ceiling where bubbles can be collected and ejected to the atmosphere via the opening channel. Patent Document 5 discloses a bubble separator that includes four separating walls for temporarily blocking the entry of ink via an inlet in order to separate the bubbles from the ink, thus preventing the bubbles from entering the recording head which would cause a discharge failure. Patent Document 6 discloses that a first ink chamber is communicated with an ink cartridge and a second ink chamber is communicated with a recording head, wherein the two chambers are communicated via a thin fluid channel configured to prevent bubbles from entering the second ink chamber.

As mentioned above, if the bubbles in the fluid channels ("common fluid chamber") in the distributing member for distributing the ink to plural heads enter the heads, a droplet discharge failure (such as the bending of the discharge path or the inability to discharge) may be caused, resulting in failure to perform a stable image forming operation. Particularly, if the common fluid chamber is designed such that the ink flows into the common fluid chamber in the same direction in which the heads are arranged, the bubbles in the ink may be easily carried to the heads via ink supply openings of the heads.

In order to reduce or prevent ripples in the flow of the ink in the common fluid chamber of the distributing member, the wall surfaces of the common fluid chamber may be partly formed of flexible material, and a resilient member (damper unit) for biasing the flexible wall surfaces may be provided in the common fluid chamber. When such a damper unit is installed, it is necessary to prevent an increase in size (such as height) of the distributing member.

Further, as mentioned above, although the distributing member for distributing ink to plural heads may be provided with a bubble-ejecting unit, bubbles may remain in a supply channel for supplying ink to the channels (common fluid chamber) in the distributing member and block the flow of ink to the distributing member, resulting in a failure to sufficiently refill the common fluid chamber.

Patent Document 1: JP2005-096208(A)

Patent Document 2: JP2003-019811(A)

Patent Document 3: JP2008-183746(A)

Patent Document 4: JP2009-012452(A)

Patent Document 5: JP2007-136760(A)

Patent Document 6: JP10-329330(A)

SUMMARY OF THE INVENTION

It is therefore an object of the present invention to reduce the entry of bubbles into the heads.

Another object of the present invention is to reduce the accumulation of bubbles in a fluid supply channel for supplying a fluid to a common fluid chamber in a distributing member.

In one aspect, the invention may provide an image forming apparatus that includes plural heads each having a nozzle configured to discharge a droplet of a recording fluid; a distributing member to which the plural heads are attached, the distributing member having an inlet portion, a supply channel portion, and a common fluid chamber communicated with the inlet portion and configured to supply the recording fluid to the plural heads; and a fluid containing unit configured to supply the recording fluid to the distributing member via the inlet portion and the supply channel portion. The distributing member includes a flow-directing wall disposed between the supply channel portion and the common fluid chamber.

In another aspect, the invention may provide an image forming apparatus that includes plural heads each having a nozzle configured to discharge a droplet of a recording fluid; a distributing member to which the plural heads are attached, the distributing member having an inlet portion and a common fluid chamber configured to supply the recording fluid to the plural heads; and a fluid containing unit configured to supply the recording fluid to the distributing member. The distributing member has an inlet portion communicated with the common fluid chamber. The inlet portion is disposed at an angle such that an exit of the inlet portion via which the recording fluid is supplied from the fluid containing unit into the common fluid chamber is higher than the other end.

DETAILED DESCRIPTION OF THE PREFERRED EMBODIMENTS

Figure 1:
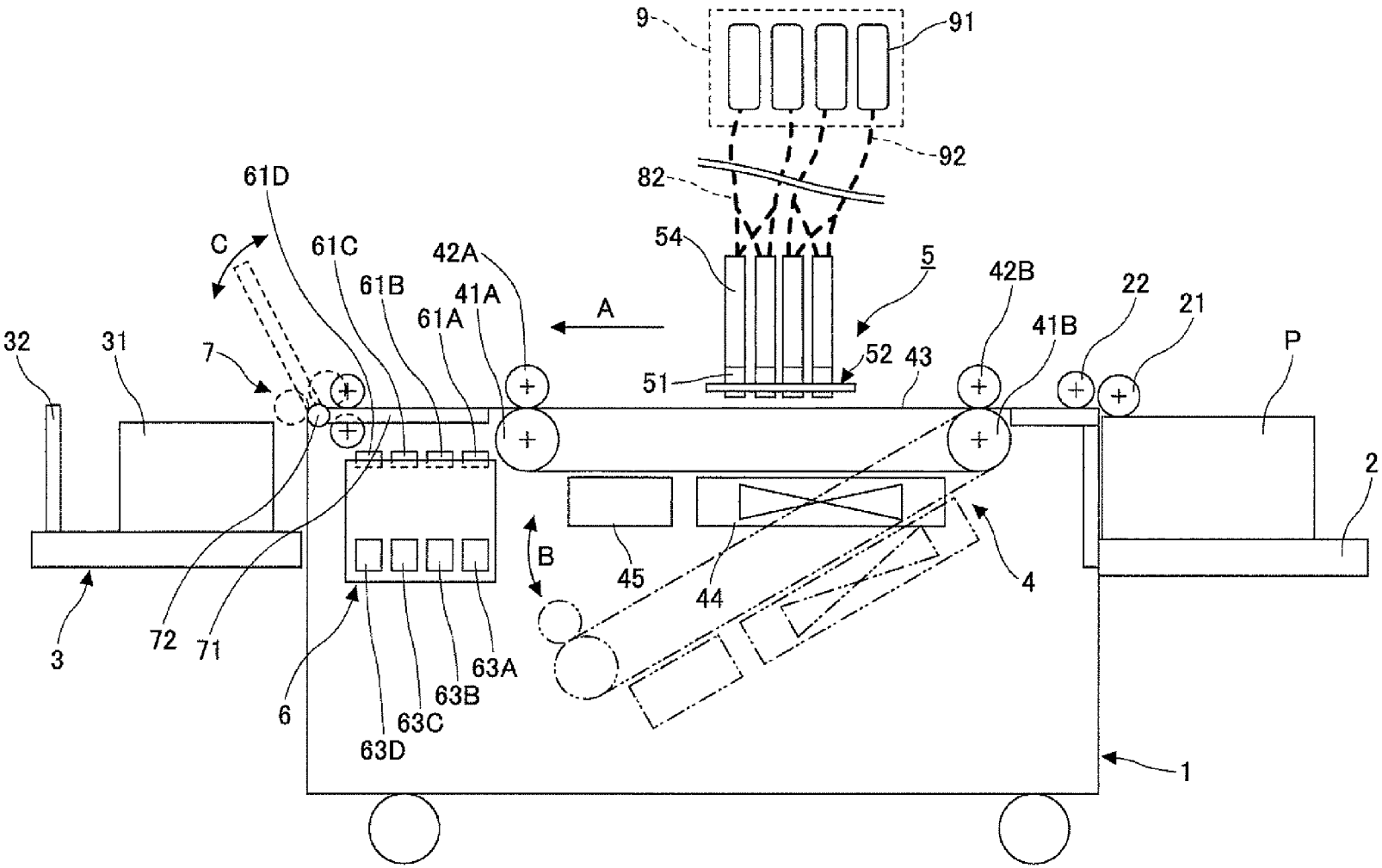
FIG. 1 is a side view of an image forming apparatus according to an embodiment of the present invention.
Figure 2:
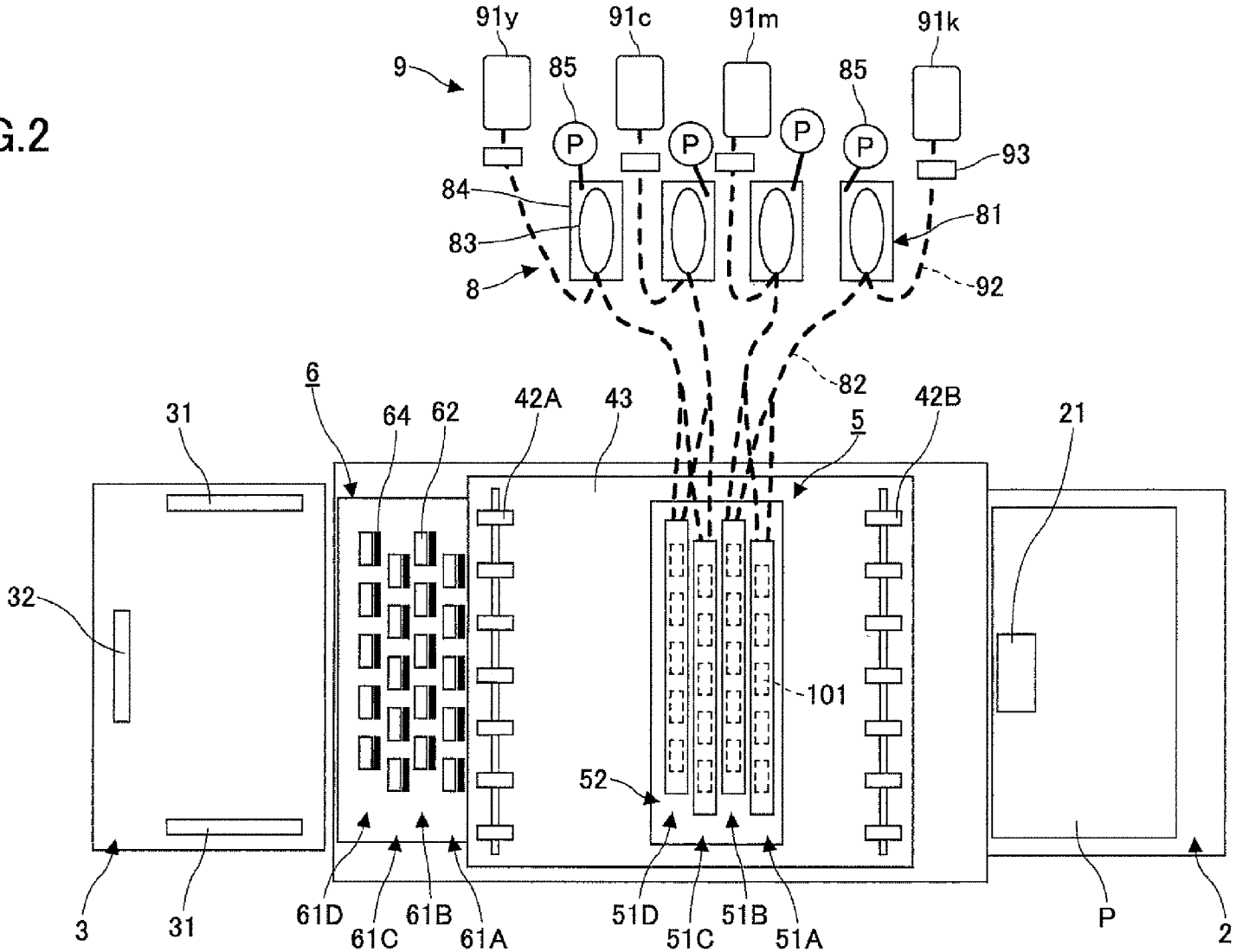
FIG. 2 is a top plan view of a main portion of the image forming apparatus of FIG. 1 and its connection with an ink supply system.

FIG. 1 is a schematic side view of a line-type image forming apparatus 100 according to an embodiment of the present invention. FIG. 2 is a schematic plan view of the line-type image forming apparatus 100. The image forming apparatus 100 includes a main body 1; a sheet-feeding tray 2 in which sheets P of recording material, such as paper, are stocked; an ejected-sheet tray 3 into which a printed sheet P is ejected; a transport unit 4 for transporting the sheet P from the sheet-feeding tray 2 to the ejected-sheet tray 3; an image forming unit 5 including a head module 51 having plural recording heads configured to discharge droplets of ink onto the sheet P as the sheet P is transported by the transport unit 4 in order to form an image (such as a character, letter, figure, pattern, etc.) on the sheet P.

The line-type image forming apparatus 100 further includes a head cleaning unit 6 (maintain/restore mechanism) configured to maintain or restore a proper condition of the recording heads in the image forming unit 5 by performing a cleaning operation at an appropriate timing such as after a printing operation; a transport guide unit 7 configured to open or close the head cleaning unit 6; a sub-tank unit 8 configured to supply ink to the head module 51; and a main tank unit 9 configured to supply ink to the sub-tank unit 8.

The main body 1 may include a front and a back plate, side plates, and a stay. The sheets P placed on the sheet-feeding tray 2 are fed onto the transport unit 4 one by one by a separating roller 21 and a sheet-feeding roller 22. The transport unit 4 includes a transport drive roller 41A, a transport driven roller 41B, and an endless transport belt 43 extended between the rollers 41A and 41B. A surface of the transport belt 43 has a number of sucking openings (not shown), so that the sheet P can be sucked via the sucking openings by a suction fan 44 disposed under the transport belt 43, thus retaining the sheet P on the transport belt 43. Transport guide rollers 42A and 42B are retained above the transport drive rollers 41A and 41B, respectively, using a guide member and the like (not shown), so that the transport guide rollers 42A and 42B are in contact with the transport belt 43 by their own weight.

The transport belt 43 is rotated by the transport drive roller 41A that is driven by a motor (not shown). The sheet P is sucked onto the transport belt 43 by the suction fan 44, as mentioned above, so that the sheet P can be transported as the transport belt 43 rotates. The transport driven roller 41B and the transport guide rollers 42A and 42B are configured to follow the rotation of the transport belt 43. Under the transport belt 43, there is disposed a blank-discharge cleaning unit 45 for removing ink droplets that are attached onto the transport belt 43 during a blank-discharge operation.

The image forming unit 5 including the plural head modules 51 is disposed above the transport unit 4. The image forming unit 5 is movable in a direction A (and in the opposite direction). During the maintain/restore operation (cleaning operation), the image forming unit 5 is moved above the cleaning unit 6. During an image forming operation, the image forming unit 5 is moved back to its position illustrated in FIG. 1, for example.

The head modules (recording head units) 51A, 51B, 51C, and 51D have plural heads 101 arranged in a row, and a distributing member ("distributor tank") 54 is integrally attached to the head modules 51A, 51B, 51C, and 51D for supplying ink to the heads 101. The head modules 51A, 51B, 51C, and 51D are mounted on a line base member 52 and arranged in order along a sheet transport direction. Each of the head modules 51A, 51B, 51C, and 51D has two lines of nozzles.

In accordance with the present embodiment, the head modules 51A and 51B are configured to discharge yellow (Y) ink droplets via the nozzles in one line and magenta (M) ink droplets via the nozzles in the other line. The head modules 51C and 51D are configured to discharge cyan (C) ink droplets via the nozzles in one line and black (K) ink droplets via the nozzles in the other line. Thus, in accordance with the present embodiment, each pair of the head modules (51A and 51B, or 51C and 51D) is configured to discharge the same color of ink droplets, and two such pairs are arranged in the sheet transport direction, the two lines of nozzles of each pair of the head modules 51 being configured to print one line corresponding to the width of the sheet P.

Above the head modules 51A to 51D, there are disposed distributor tanks 54 at positions corresponding to the head modules 51A through 51D for supplying the various colors of ink to the heads 101. A sub-tank 81 is disposed upstream of the distributor tank 54 and connected to the distributor tank 54 via supply tubes 82. A main tank 91 is disposed further upstream of the sub-tank 81 and connected to the sub-tank 81 via a supply channel including supply tubes 92.

A transport guide unit 7 for ejecting the sheet P onto the ejected-sheet tray 3 is disposed downstream of the transport unit 4. The ejected-sheet tray 3 includes a pair of side fences 31 for regulating the sheet P in its width direction and an end fence 32 for regulating the front edge of the sheet P.

The maintain/restore mechanism (head cleaning unit) 6 includes four lines of cleaning units 61A through 61D (which may be collectively referred to as "the cleaning unit 61") for the respective head modules 51A through 51D of the image forming unit 5. The cleaning units 61A through 61D may include a cap member 62 for capping the nozzle surface of the heads 101 of the head modules 51 and a wiping member 64 for wiping the nozzle surfaces. The cap member 62 of one cleaning unit may be configured to be vertically movable independently of the cap member 62 of another cleaning unit. Below the cleaning units 61A through 61D, there is disposed sucking pumps 63A through 63D for sucking ink via the nozzles of the heads 101 while the nozzle surfaces are capped with the cap member 62.

In accordance with the present embodiment, a cleaning operation (maintain/restore operation) may be performed after a printing operation. The cleaning operation may involve sucking ink via the nozzles of the heads 101 while the nozzle surfaces are capped with the cleaning unit 61, or cleaning the nozzle surfaces by the wiping member 64, as illustrated in FIG. 1. Specifically, when the cleaning operation is performed, the transport unit 4 is moved about an axis of the transport driven roller 41B in a direction B, thus increasing the space between the transport unit 4 and the image forming unit 5 and ensuring a sufficient space for the movement of the image forming unit 5. At this time, a transport guide plate 71 of the transport guide unit 7 disposed above the head cleaning unit 6 is also moved about an axis 72 in a direction C, thus exposing an upper portion of the head cleaning unit 6. After the transport unit 4 and the transport guide unit 7 are thus opened (released), the image forming unit 5 is moved in a sheet transport direction A and stopped above the head cleaning unit 6, where the cleaning unit 61 is elevated to perform the cleaning operation (maintain/restore operation) of the head modules 51A through 51D.

Figure 3:
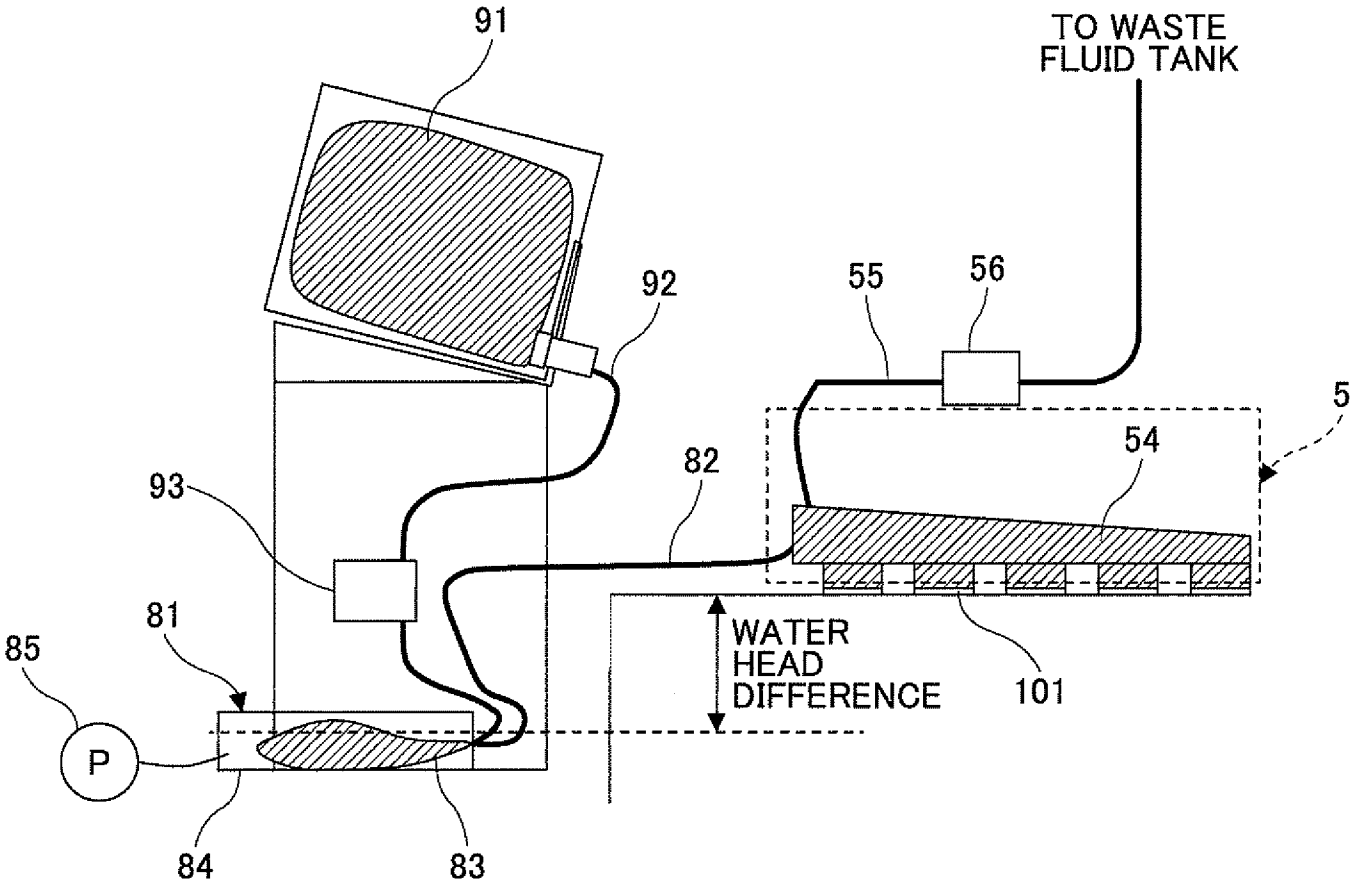
FIG. 3 illustrates the ink supply system of the image forming apparatus.

FIG. 3 illustrates an ink supply system of the image forming apparatus 100. The ink supply system includes the sub-tank 81, the distributor tank 54 of the head module 51, and the main tank 91. The sub-tank 81 is connected to the distributor tank 54 via the supply tube 82. The height of the sub-tank 81 relative to the heads 101 is adjusted such that there is a water head difference of −20 to −70 mmAq that is required for producing an appropriate negative pressure for maintaining a meniscus in the nozzles of the heads 101. The diameter of the supply tube 82 is not particularly limited. It may be 6 mm as in the present embodiment, or as much as 10 mm. If the diameter of the supply tube 81 is too small, resistance (pressure loss) may increase so much that the ink cannot be properly discharged via the heads 101, thereby preventing the formation of a desired image.

In accordance with the present embodiment, the sub-tank 81 includes a casing 84 in which a flexible pack 83 that contains ink is hermetically contained. This structure of the sub-tank 81 prevents direct contact between the ink and the atmosphere, thus preventing an increase in the viscosity of the ink due to evaporation of water content, maintaining a constant level of oxygen dissolved in the ink, and preventing the formation of bubbles in the heads 101.

The sub-tank 81 is connected to a pressure pump 85 for pressurizing the space between the pack 83 and the casing 84. In a maintenance operation which may be performed prior to printing after a period of no printing, the pressure within the casing 84 may be increased by the pressure pump 85 so as to cause the ink to be discharged out of the nozzles of the heads 101 for nozzle-maintenance purposes. Such a maintenance operation is performed by moving the image forming unit 5 above the cleaning unit 6.

The sub-tank 81 is connected to the main tank 91 via a supply tube 92 (supply channel) having an electromagnetic valve 93. The supply of ink from the main tank 91 to the sub-tank 81 is controlled by the electromagnetic valve 93. Above the distributor tank 54, there are disposed a tube 55 and an electromagnetic valve 56. The tube 55 provides an air-ejection channel communicated with a waste-liquid tank (not shown). The flow of air through the tube 55 may be controlled by the electromagnetic valve 56. For example, when removing air out of the distributor tank 54 for an initial loading operation, the electromagnetic valve 56 is opened. A top plate of the common fluid chamber inside the distributor tank 54 is inclined so as to facilitate the air removal operation.

Figure 4:
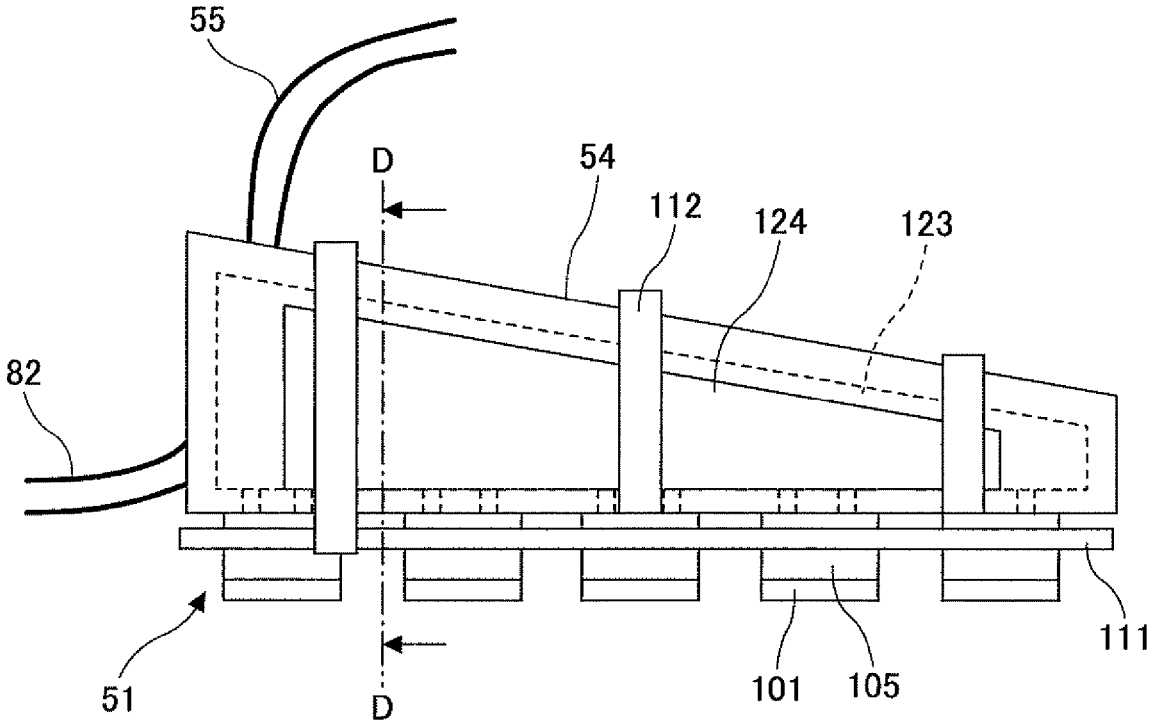
FIG. 4 is a side view of a head module.
Figure 5:
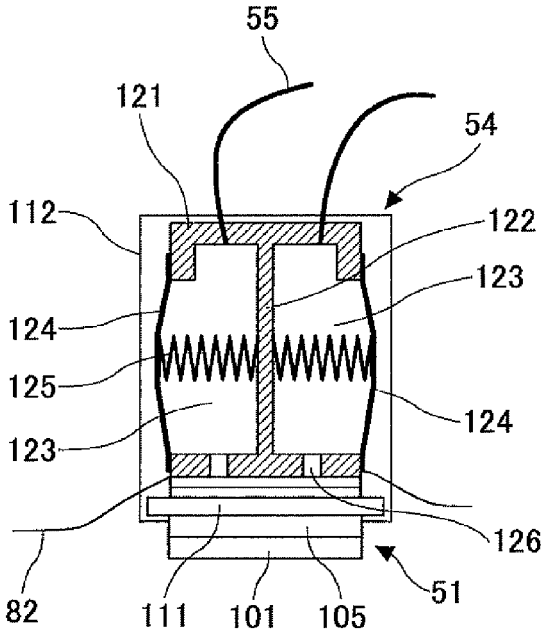
FIG. 5 is a cross section taken along line D-D of FIG. 4.
Figure 6:
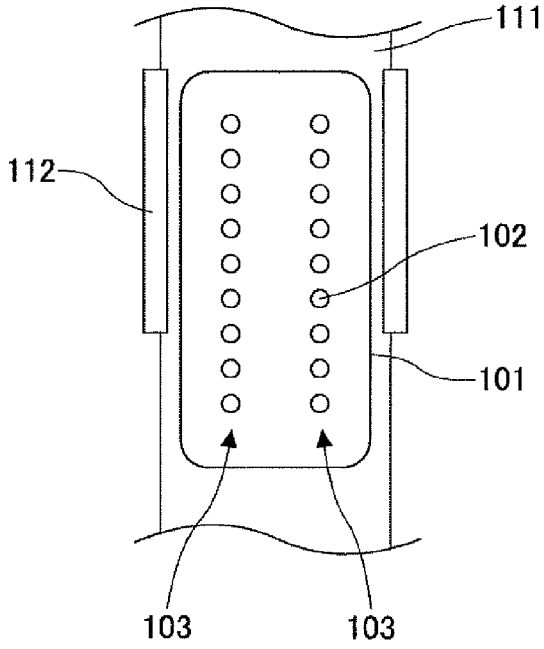
FIG. 6 is a bottom view of a head of the head module of FIG. 4.

Referring to FIGS. 4 through 6, the head module 51 is described in detail. FIG. 4 is a side view of the head module 51. FIG. 5 is a cross section taken along line D-D of FIG. 4. FIG. 6 is a bottom view of one of the heads 101. As illustrated in FIG. 6, the head 101 has two lines 103, 103 of the nozzles 102. The lines 103, 103 of the nozzles 102 are configured to discharge different colors of ink droplets. The heads 101 may be fixed to the base member 111 using screws, adhesive, or glue (which are not shown), for example. The head 101 is also fixed to the distributor tank 54 by a distributor tank fixing member 112. The distributor tank fixing member 112 may include a plate spring configured to press the distributor tank 54 against the head 101. A filter 105 is disposed between the head 101 and the distributor tank 54.

The distributor tank 54 includes a tank casing 121 having a pair of common fluid chambers 123, 123 for different colors of ink extending along the lines of the nozzles 102 and partitioned by a separating wall 122. The wall surfaces of the common fluid chamber 123 include flexible members 124 that are biased outward by a resilient member 125, such as a spring, disposed in the common fluid chambers 123. The flexible members 124 and the resilient member 125 constitute a damper unit (mechanism) for damping external mechanical vibrations, ripples and the like. The flexible member 124 may be formed of aluminum, low-density polyethylene, high-density polyethylene, Teflon, saran, vinyl chloride, PVA, polypropylene, nylon, or PET. The flexible member 124 also has a gas barrier function. Preferably, the material of the tank casing 121 is the same as that of the flexible member 124 for ease of bonding. However, the tank casing 121 may be made of metal material. In another embodiment of the present invention, the distributor tank 54 may not have the damping mechanism.

In another embodiment of the present invention, instead of dividing the inside of the distributor tank, each head may be configured to discharge one color of ink. The image resolution may be doubled over the above-described embodiment by increasing the number of the heads 101, for example.

Example 1

Figure 7:
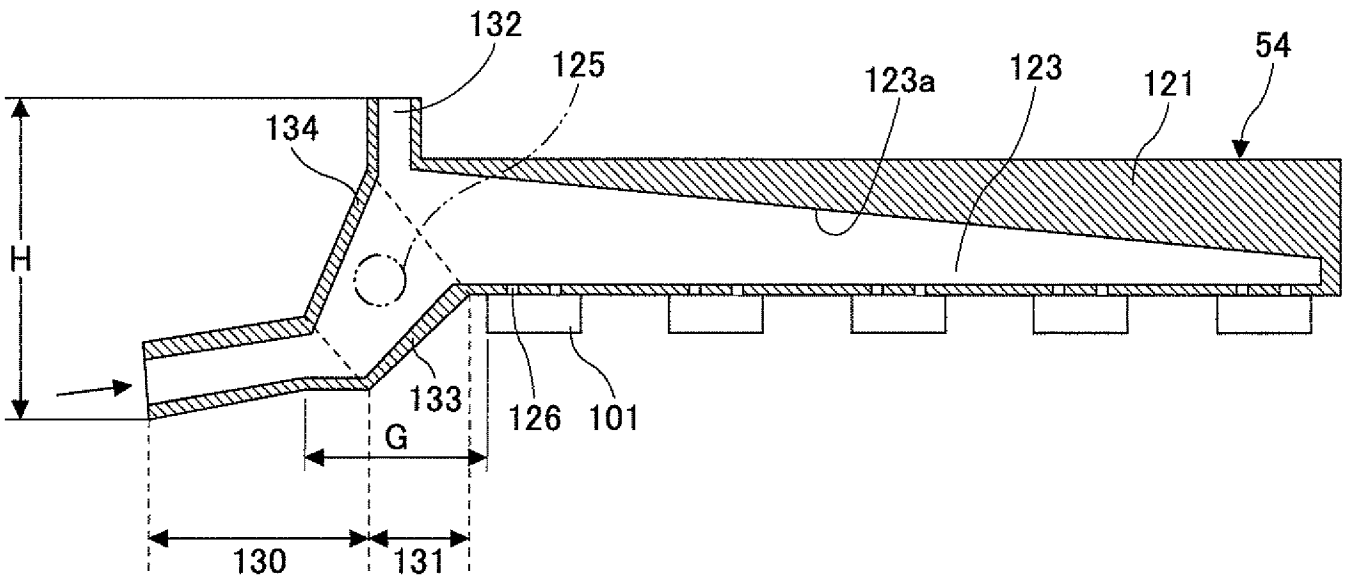
FIG. 7 is a cross section of a distributor tank according to an embodiment of the present invention.

FIG. 7 is a cross section of the distributor tank 54 according to Example 1. In this embodiment, the tank casing 121 in which the common fluid chamber 123 is formed for distributing ink to the heads 101 has an inclined top member 123*a*. The distributor tank 54 has an inlet portion 130 on one end via which ink flows into the common fluid chamber 123 through an ink supply channel portion 131. A bubble discharge opening 132 is formed above the ink supply channel portion 131 which may be connected to the tube 55 (air-ejection channel; see FIG. 3) as mentioned above. The tank casing 121 also has ink supply openings 126 for supplying ink to the heads 101.

The inlet portion 130 of the distributor tank 54 is disposed lower than the nozzle surfaces of the heads 101. The ink supply channel portion 131 of the distributor tank 54 includes an upper sloping wall 134 and a lower sloping wall 133 disposed lower than the ink supply openings. Thus, the ink supply channel portion 131 extends upward toward the common fluid chamber 123 at an angle, with an increasing cross-sectional area of opening. The inlet portion 130 also extends slightly upward as it connects to the ink supply channel portion 131 with an angle of inclination of about 3 degrees, for example. The aforementioned resilient member 125 (damper unit) may be disposed within the ink supply channel portion 131.

Figure 8A:
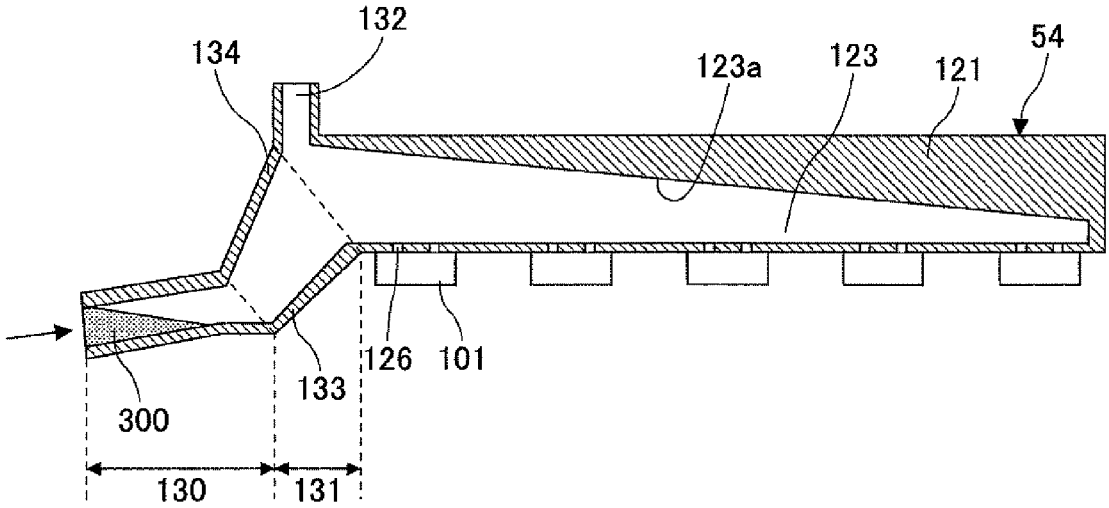
FIG. 8A is a cross section of the distributor tank where an ink is about to enter a common fluid chamber of the distributor tank.
Figure 8B:
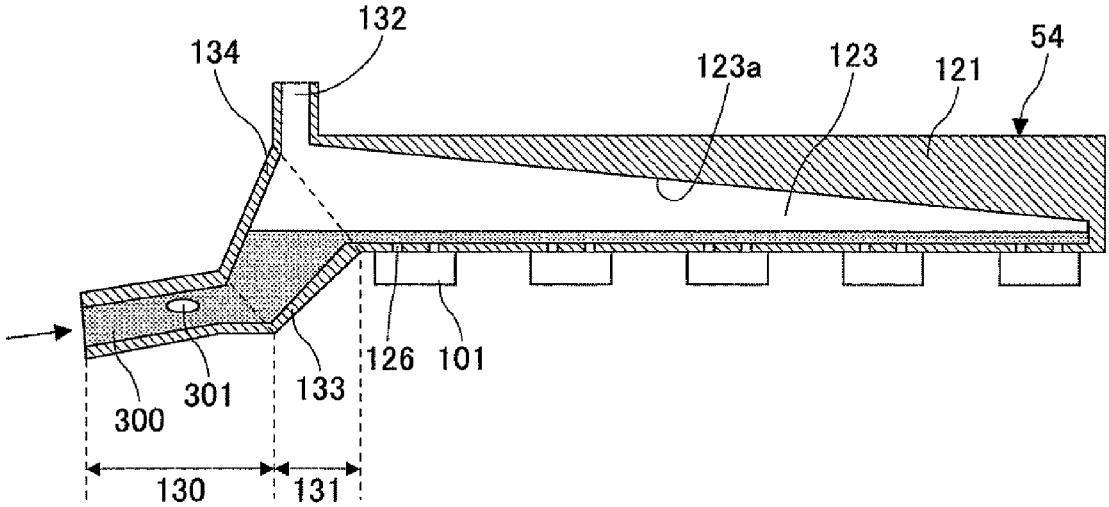
FIG. 8B is a cross section of the distributor tank where the ink has entered the common fluid chamber.
Figure 8C:
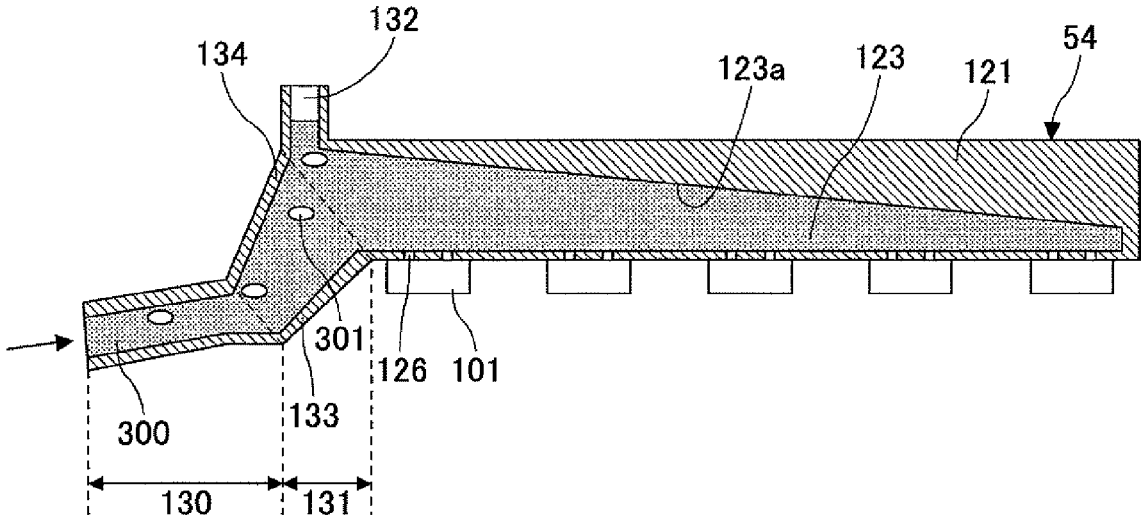
FIG. 8C is a cross section of the distributor tank illustrating how bubbles are ejected via a bubble discharge opening.

With reference to FIG. 8, the function of the distributor tank 54 according to the present embodiment is described. When ink 300 is supplied to the distributor tank 54, the ink 300 enters the inlet portion 130, as illustrated in FIG. 8A. Then, the ink 300 reaches the common fluid chamber 123 via the ink supply channel portion 131, as illustrated in FIG. 8B. At this time, if there is a bubble 301 in the ink 300 as it enters the ink supply channel portion 131, the bubble 301 floats along the upper or lower sloping wall 131 or 133 and eventually enters the bubble discharge opening 132, as illustrated in FIG. 8C.

Because of the upper and lower sloping walls 134 and 133, the ink 300 is caused to flow upward before entering the ink supply channel portion 131 in a lateral direction (along the direction in which the heads are arranged), so that the bubble 300 in the ink 300 can be prevented from entering the heads 101 via the ink supply openings 126. Further, because the opening area of the ink supply channel portion 131 becomes greater as it connects to the common fluid chamber 123, the flow rate of the ink 300 slows as it passes the ink supply channel portion 131, thus preventing the occurrence of bubbles in the ink 300 as it is supplied into the distributor tank 54 at a high flow rate when the tank is vacant. Also, any bubbles that may enter the distributor tank 54 at a high flow rate when the tank is filled with ink can be prevented from entering the heads 101. By providing the resilient member 125 (damper unit) in the ink supply channel portion 131 (see FIG. 7), the increase in height of the common fluid chamber 123, and hence the distributing member 54, can be prevented.

Further, in accordance with the present embodiment, a long interval G (such as 10 mm or more) can be provided between an entry portion of the ink supply channel portion 131 (where the inlet portion 130 connects to the ink supply channel portion 131) and the heads 101, as illustrated in FIG. 7, so that the entry of the bubble 301 into the heads 101 can be prevented reliably.

Example 2

Figure 9:
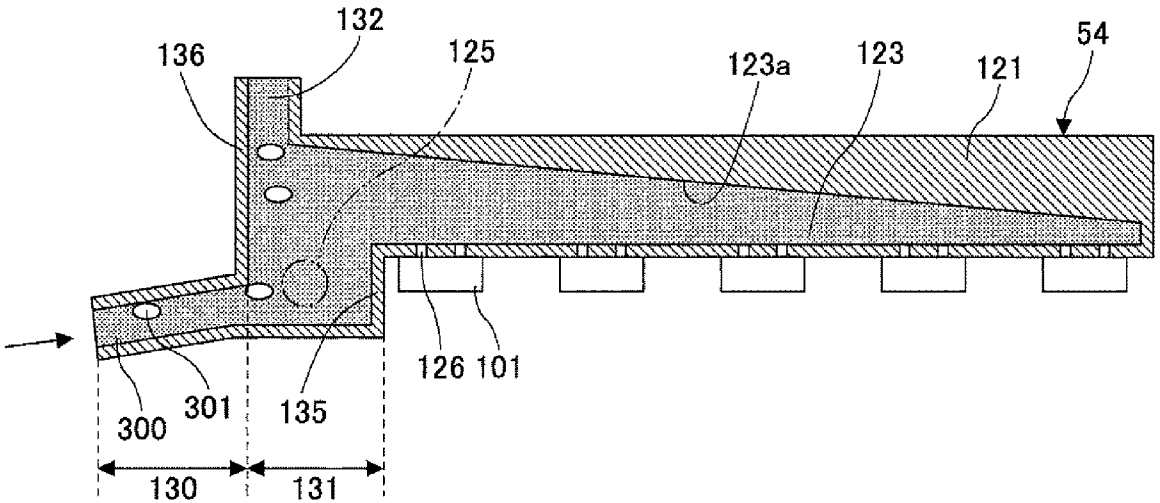
FIG. 9 is a cross section of the distributor tank according to another embodiment of the present invention.

The distributor tank 54 according to Example 2 of the present invention is described with reference to FIG. 9 illustrating a cross section of the distributor tank 54. In accordance with the present embodiment, the ink supply channel portion 131 includes a first vertical wall 135 and a second vertical wall 136. The inlet portion 130 is inclined upward (with an inclination angle of 3 degrees or more, for example) before it connects to the ink supply channel portion 131. The ink supply channel portion 131 having the first and the second vertical walls 135 thus extends vertically upward. Thus, in accordance with the present embodiment, the ink inlet portion 131 has a large area, allowing the resilient member 125 to be easily installed.

In accordance with the present embodiment, the first and the second vertical walls 135 and 136 direct the flow of the ink 300 that may contain bubbles 301 vertically upward even if the ink 300 flows into the common fluid chamber 123 from diagonally below. Thus, the bubble 131 in the ink 300 is directed to rise and ejected via the bubble discharge opening 132, instead of flowing directly into the heads 101. Further, the resilient member 125 (damper) can be installed without excessively increasing the height H of the distributor tank 54 (see FIG. 7).

Example 3

Figure 10:
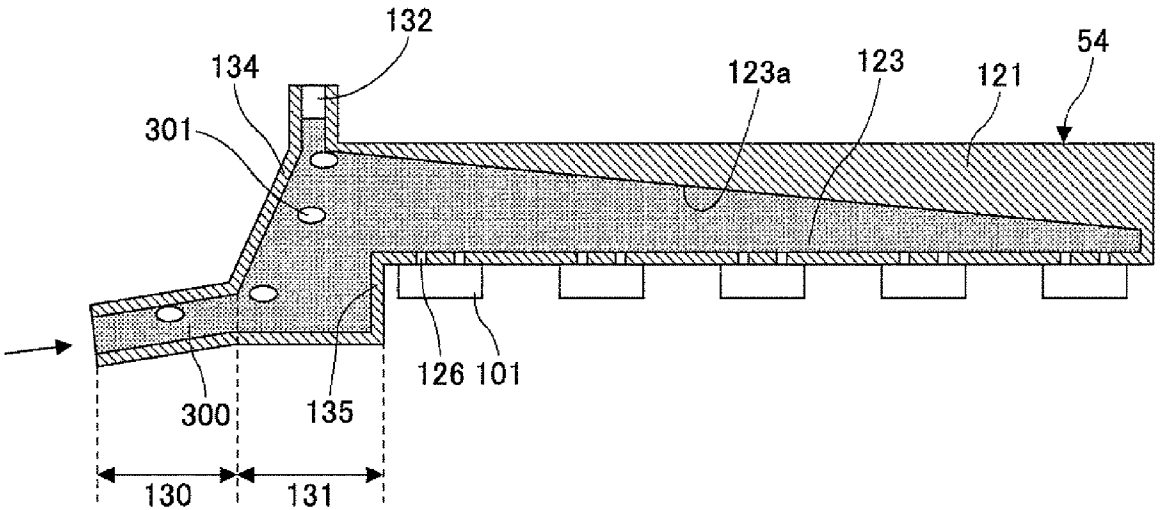
FIG. 10 is a cross section of the distributor tank according to another embodiment of the present invention.

The distributor tank 54 according to Example 3 of the present invention is described with reference to FIG. 10 illustrating a cross section of the distributor tank 54. Example 3 is a combination of Examples 1 and 2. Namely, the distributor tank 54 includes a vertical wall 135 and an inclined wall 134 disposed opposite the vertical wall 135. In this way, the size of the ink supply channel portion 131 can be increased compared with Example 2.

Example 4

Figure 11:
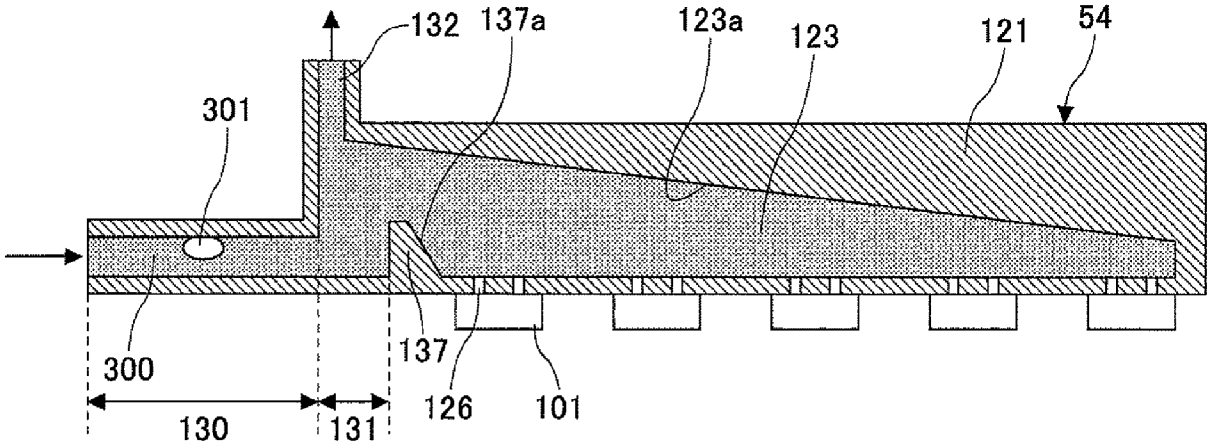
FIG. 11 is a cross section of the distributor tank according to another embodiment of the present invention.

The distributor tank 54 according to Example 4 of the present invention is described with reference to FIG. 11 illustrating a cross section of the distributor tank 54. In accordance with the present embodiment, the inlet portion 130 and the ink supply channel portion 131 are configured to direct the ink 300 to flow horizontally, before it is directed upward by a wall 137 provided between the ink inlet portion 133 and the ink supply openings 126 communicated with the heads 101. The wall 137 has an inclined surface 137*a* on the side of the ink supply openings 126.

In accordance with Example 4, advantageous effects similar to those of the other embodiments can be obtained. However, in order to secure the area for the resilient member 125, the height H of the distributing member 54 may increase compared to the other embodiments. The sloping inclined surface 137*a* of the wall 137 on the side of the ink supply openings 126 prevents the entry of the bubble 301 into the heads 101 in an initial ink charge operation, as may occur if the surface is not inclined as illustrated in a FIG. 12.

Example 5

Figure 13:
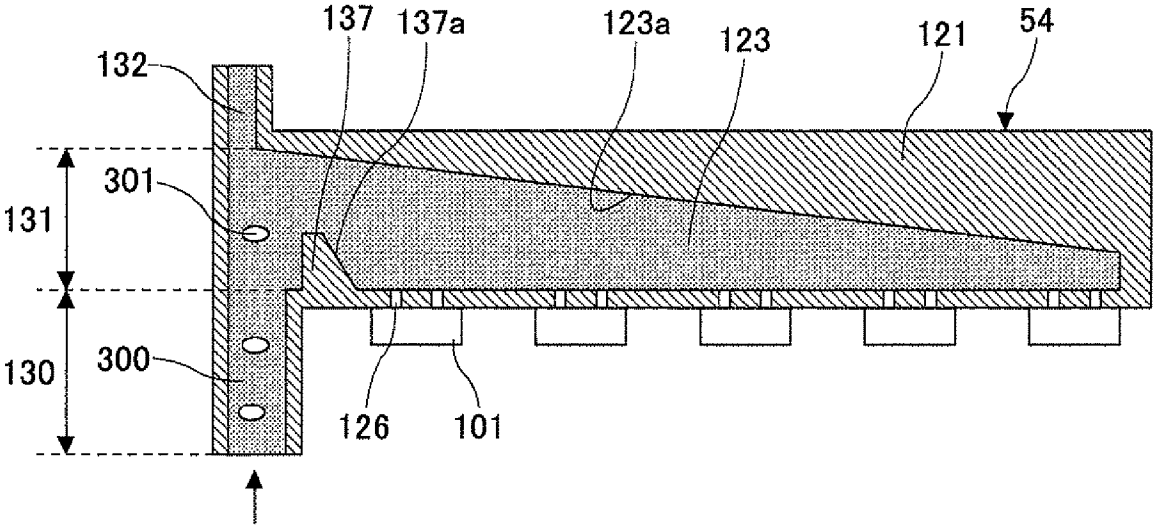
FIG. 13 is a cross section of the distributor tank according to another embodiment of the present invention.

The distributor tank 54 according to Example 5 of the present invention is described with reference to FIG. 13 illustrating a cross section of the distributor tank 54. In accordance with the present embodiment, the inlet portion 130 and the ink inlet portion 133 extend vertically. As in Example 4, a wall 137 is provided between the ink inlet portion 133 and the ink supply openings 126, the wall 137 having an inclined surface 137*a* on the side of the ink supply openings 126. In accordance with Example 5, advantageous effects similar to those of the other embodiments can be obtained.

Comparative Example

Figure 14:
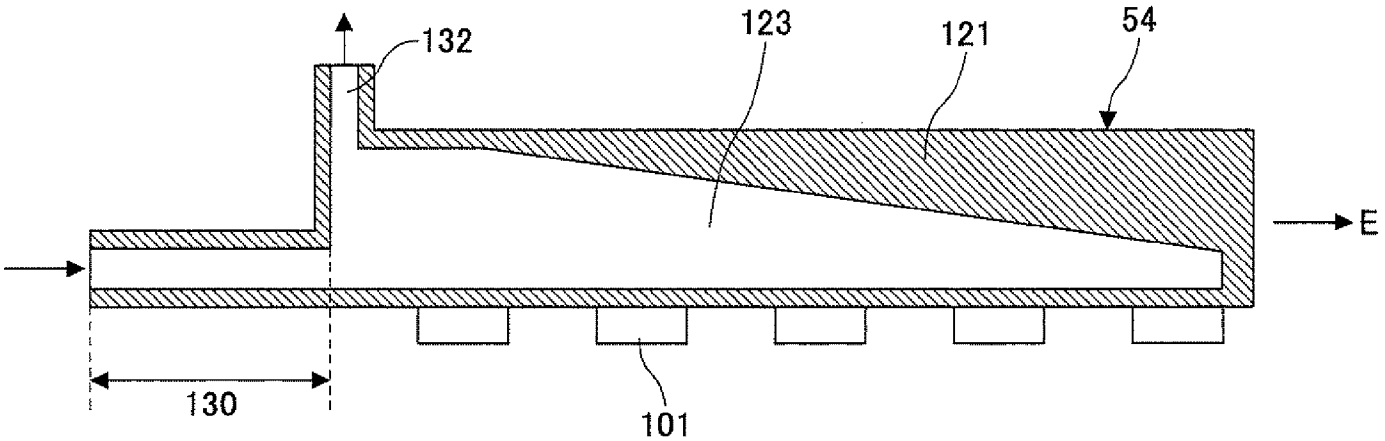
FIG. 14 is a cross section of the distributor tank according to another comparative example.

FIG. 14 is a cross section of a conventional distributor tank 54. The distributor tank 54 has a common fluid chamber 123 and an inlet portion 130 via which ink is supplied to the common fluid chamber 123. The distributor tank 54 also includes a bubble discharge opening 132 formed at the highest portion of the common fluid chamber 123. The inlet portion 130 extends substantially horizontally from one end of the common fluid chamber 123 (i.e., one end of the direction along which the heads 101 are arranged). By disposing the inlet portion 130 horizontally, ink can be smoothly supplied to the common fluid chamber 123 when it is empty while preventing the occurrence of bubbles.

Figure 15A:
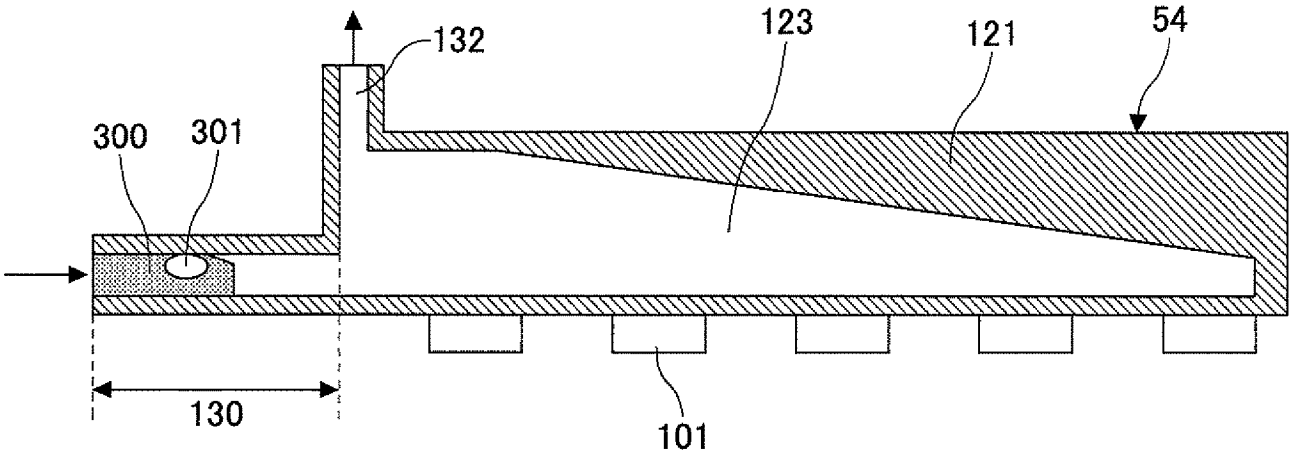
FIG. 15A is a cross section of a conventional distributor tank illustrating a problem of the conventional distributor tank.
Figure 15B:
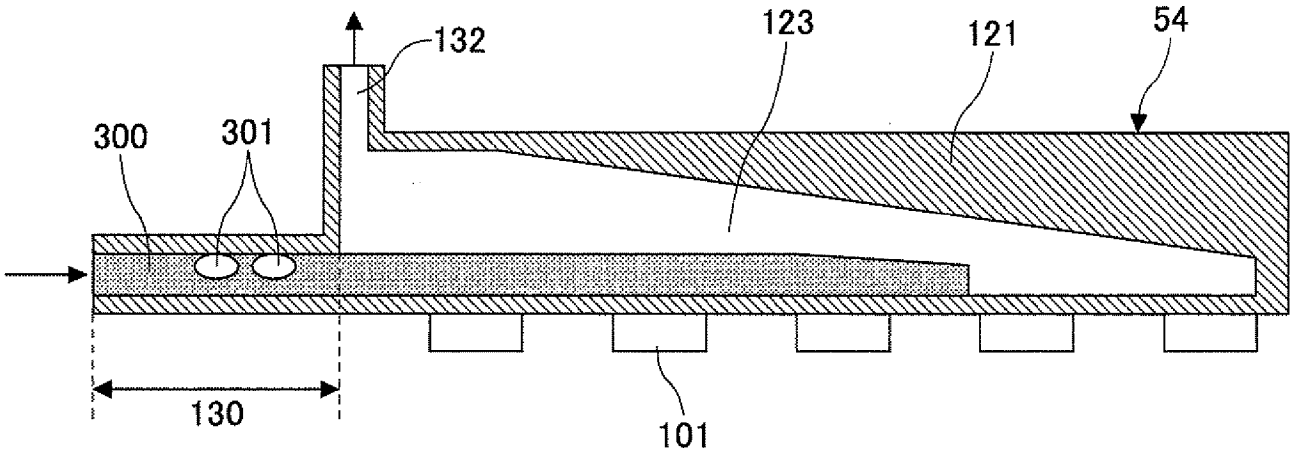
FIG. 15B is another cross section of the conventional distributor tank where ink 300 has just entered the common fluid chamber.
Figure 15C:
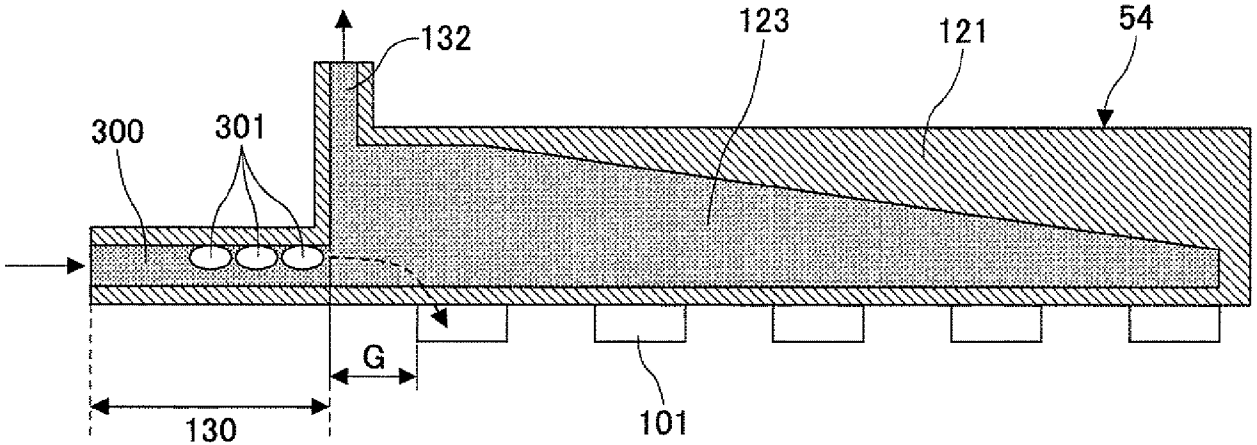
FIG. 15C is another cross section of the conventional distributor tank illustrating how bubbles may enter the head.

However, if a bubble is produced upstream of the inlet portion 130, or if the downstream end E of the distributor tank 54 is lowered by the tilting of the apparatus main body, the ink may remain in the inlet portion 130. Specifically, with reference to FIG. 8, if a bubble 301 enters the inlet portion 130 when the end (E) of the distributor tank 54 is lower than the inlet portion 130, for example, the bubbles 301 may gradually accumulate in the inlet portion 130 as the ink enters common fluid chamber 123, as illustrated in FIGS. 15A, 15B, and 15C. When the supply channel (inlet portion 130) has the diameter of 6 mm, for example, it may be impossible to move the bubbles 301 once they attach to the wall surfaces of the inlet portion 130, whether by pressurizing or sucking the ink 300. Although the bubbles 301 may be more easily moved when the supply channel has a smaller diameter (such as 4 mm or less) by pressurizing or sucking, such a small diameter increases pressure loss and thus adversely affects the droplet discharge operation.

If the distance G between an exit portion of the inlet portion 130 and the most adjacent one of the heads 101 is too short, the bubble 301 may enter the head 101 via the ink supply openings 506. If that happens, an ink discharge failure (nozzle down) may occur.

Example 6

Figure 16:
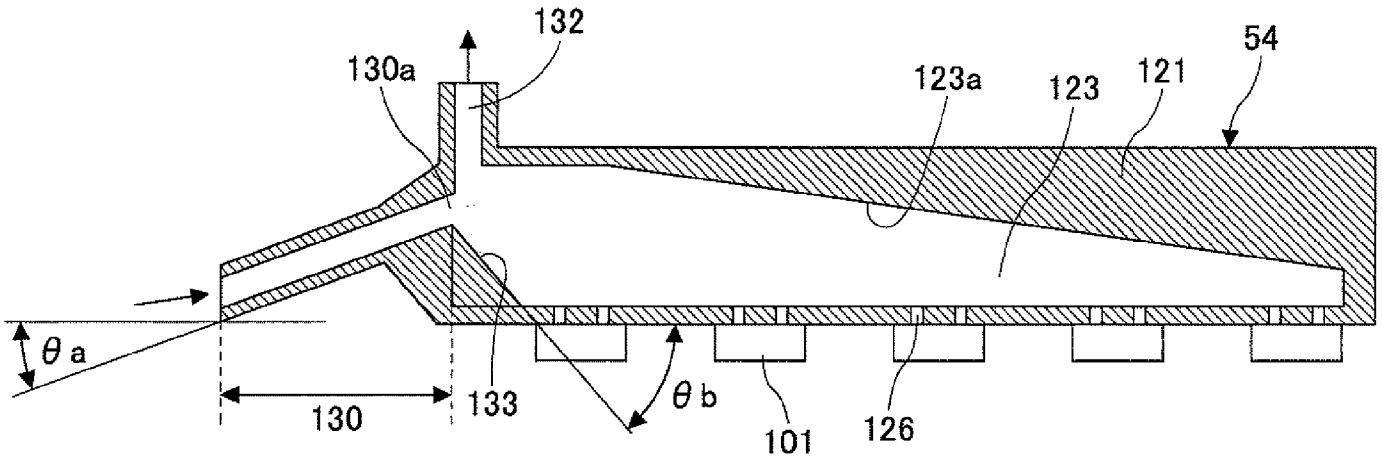
FIG. 16 is a cross section of the distributor tank according to another embodiment of the present invention.

The distributor tank 54 according to Example 6 of the present invention is described with reference to FIG. 16 illustrating a cross section of the distributor tank 54. In accordance with the present embodiment, the inlet portion 130 is inclined at an angle θa with respect to the plane of the distributing tank 54 on which the heads 101 are disposed. A bubble discharge opening 132 is provided at the highest portion of the top member 123*a* of the common fluid chamber 123 and may be connected to the tube 55 (air-ejection channel; see FIG. 3). In the common fluid chamber 123, there is provided an inclined portion 133 having an inclined surface that slopes down from an exit 130*a* of the inlet portion 130 at an angle θb. The tank case 121 has ink supply openings for supplying ink to the heads 101.

Figure 17A:
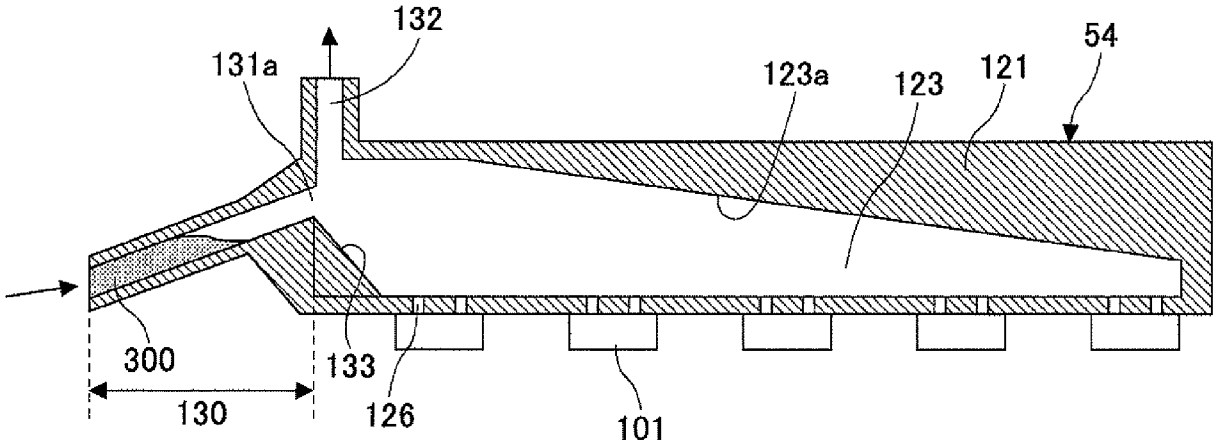
FIG. 17A is a cross section of the distributor tank illustrating the ink about to enter the common fluid chamber.
Figure 17B:
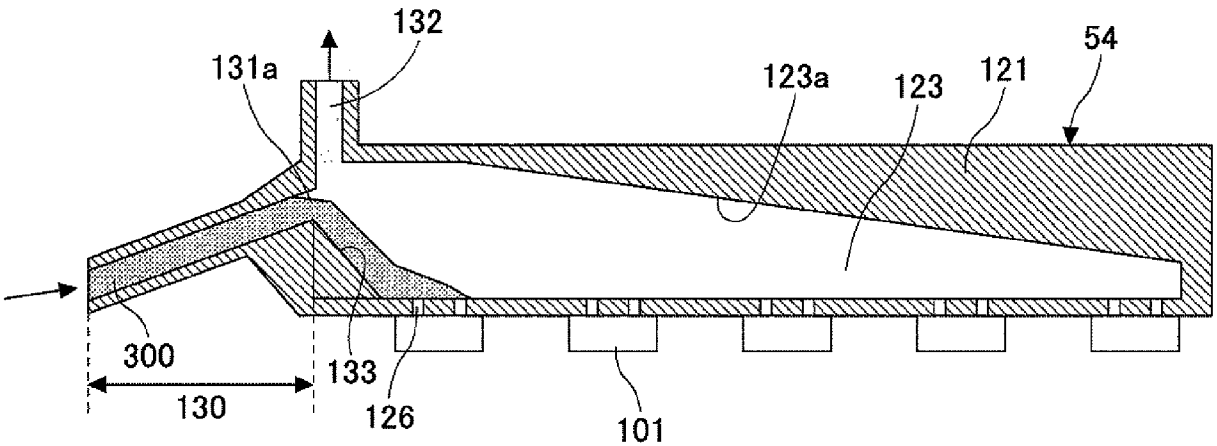
FIG. 17B is a cross section of the distributor tank illustrating the ink having just entered the common fluid chamber.
Figure 17C:
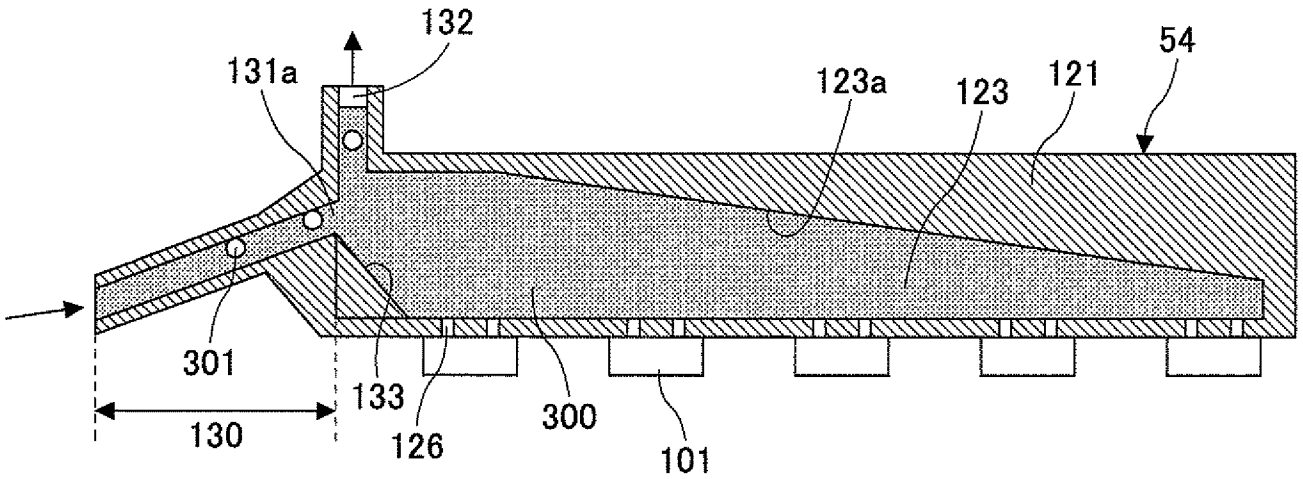
FIG. 17C is a cross section of the distributor tank illustrating how the bubbles are ejected via a bubble discharge opening.

With reference to FIGS. 17A, 17B, and 17C, the function of the distributor tank 54 according to the present embodiment is described. The ink 300 is supplied via the inlet portion 130 (FIG. 17A) and then enters the common fluid chamber 123 (FIG. 17B). If there is a bubble 301 in the ink 300 as it flows via the inlet portion 130, the bubble 301 floats upward along the inlet portion 130, which is inclined upward, and is eventually ejected via the bubble discharge opening 132, as illustrated in FIG. 17C. Preferably, the inclination angle θa (see FIG. 16) of the inlet portion 130 is 3° or more and less than 90°.

Figure 18:
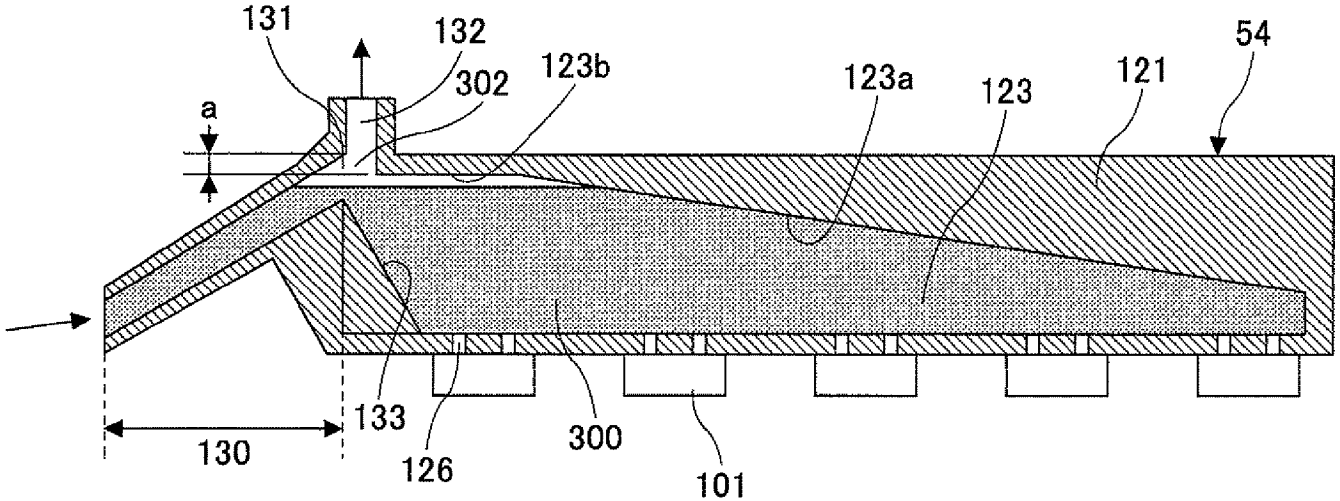
FIG. 18 is a cross section of the distributor tank according to another embodiment of the present invention.
Figure 19:
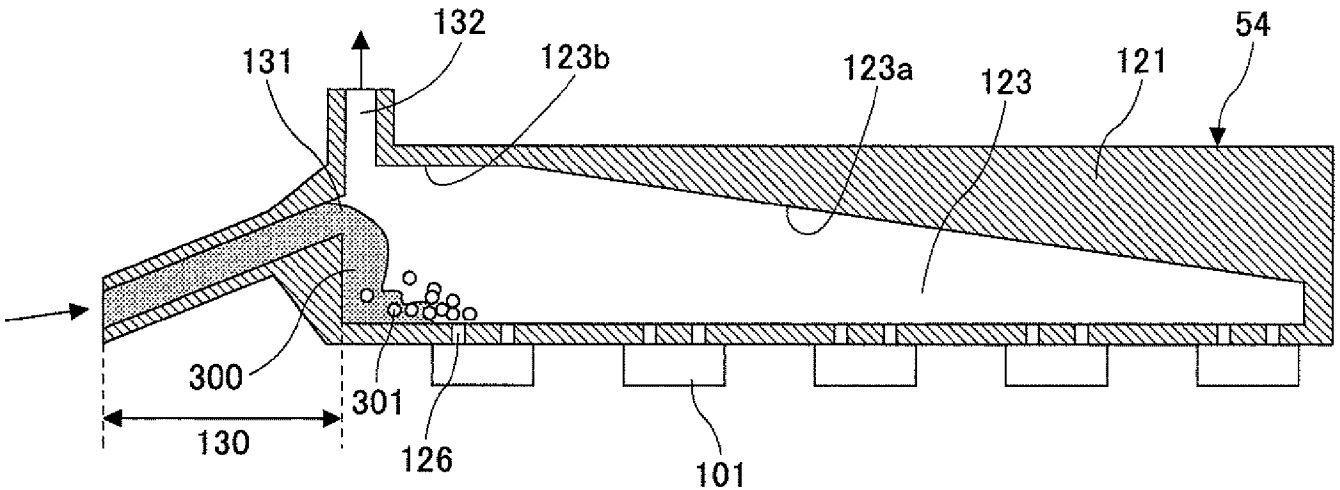
FIG. 19 is a cross section of the distributor tank according to another comparative example illustrating how bubbles may be produced.

By disposing the exit 130*a* of the ink supply channel portion 131 as close to the bubble discharge opening 132 as possible (namely, higher), the ejection of the bubble 301 via the bubble discharge opening 132 may be facilitated. However, if the exit 130*a* of the inlet portion 130 is disposed too high, such as illustrated in FIG. 18 (where an upper end of the exit 130*a* is positioned higher than an upper surface 123*b* of the top member 123*a* by a height a), the passageway of the exit 130*a* may become so narrow upon the occurrence of an air pocket 302 at the top of the common fluid chamber 123 that an ink discharge failure may be caused by increase in fluid resistance. Thus, the exit 130*a* of the inlet portion 130 is formed lower than the upper surface 123*b* of the top member 123*a* of the common fluid chamber 123.

Figure 12:
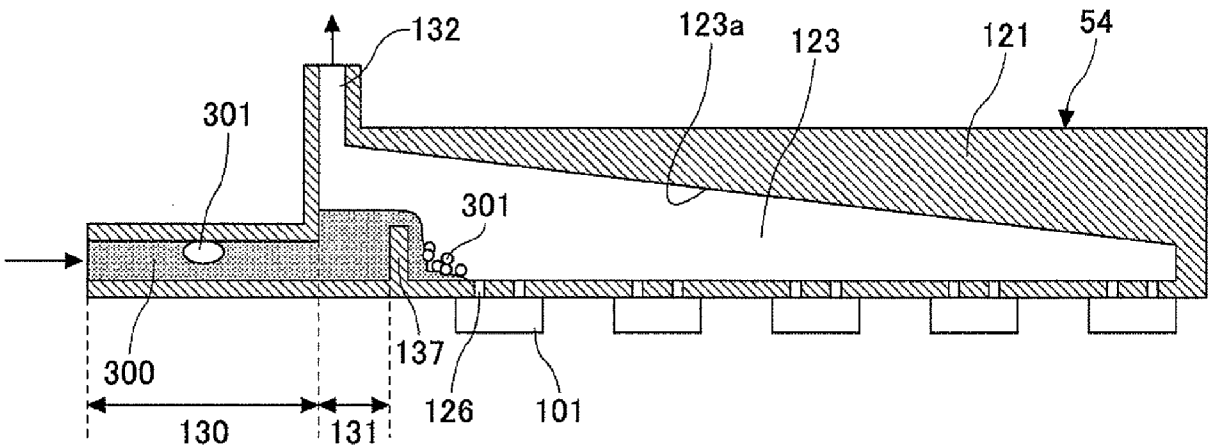
FIG. 12 is a cross section of the distributor tank according to a comparative example.

The inclined portion 133 of the common fluid chamber 123 that slopes downward allows the ink to slow down as it enters the common fluid chamber 123, thus preventing the generation of bubbles in the ink 300. If there is no such inclined portion 133 at the inlet of the common fluid chamber 123, the ink 300 would fall vertically downward as it exits the exit 130*a*, as illustrated in FIG. 12, and the bubbles 301 may be produced and they may enter the heads 101. The inclination angle θb of the inclined portion 133 (see FIG. 16) should be minimized as much as possible, preferably to 60 degrees or less.

Thus, the distributing member 54 includes the inlet portion 130 for supplying the ink 300 (fluid) to the common fluid chamber 123, where the inlet portion 130 is inclined with respect to the common fluid chamber 123 such that the inlet portion 130 joins the common fluid chamber 131 at an elevated height. Thus, the bubbles that may enter or be produced in the inlet portion 130 are guided along the inlet portion 130 due to its inclination, and eventually ejected via the bubble ejecting channel 132, thus preventing the accumulation of bubbles in the inlet portion 130 when supplying the ink 300 to the common fluid chamber 123.

Example 7

Figure 20:
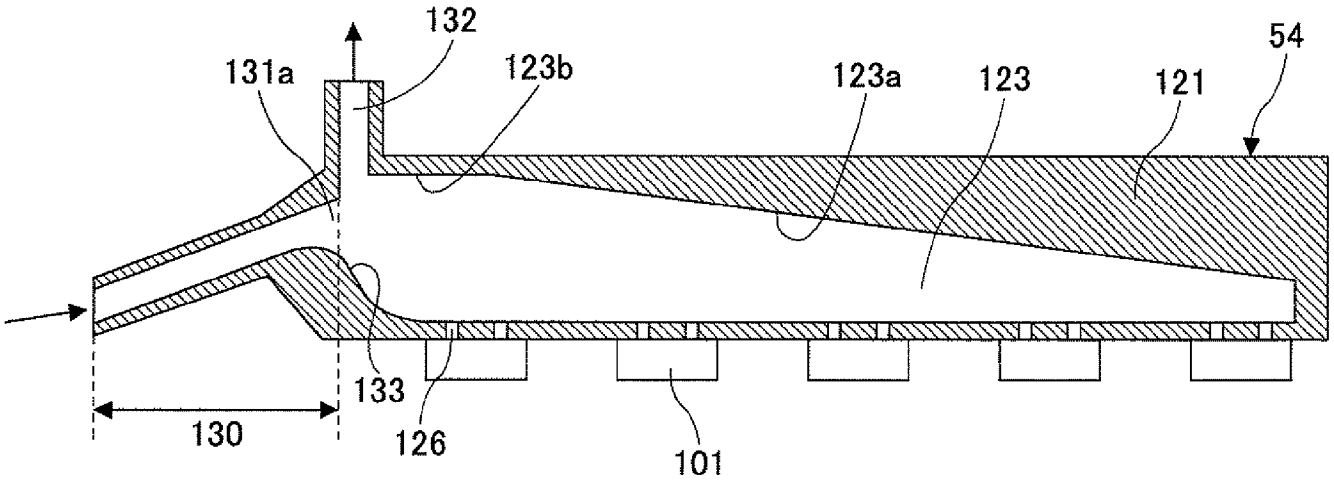
FIG. 20 is a cross section of the distributor tank according to another embodiment of the present invention.

The distributor tank 54 according to another embodiment of the present invention is described with reference to FIG. 20 illustrating a cross section of the distributor tank 54. In accordance with the present embodiment, the inclined portion 133 at the exit 130*a* of the inlet portion 130 is curved. In this way, the ink 300 can be guided more smoothly as it enters the common fluid chamber 123, thus preventing the development of bubbles more effectively.

Example 8

Figure 21:
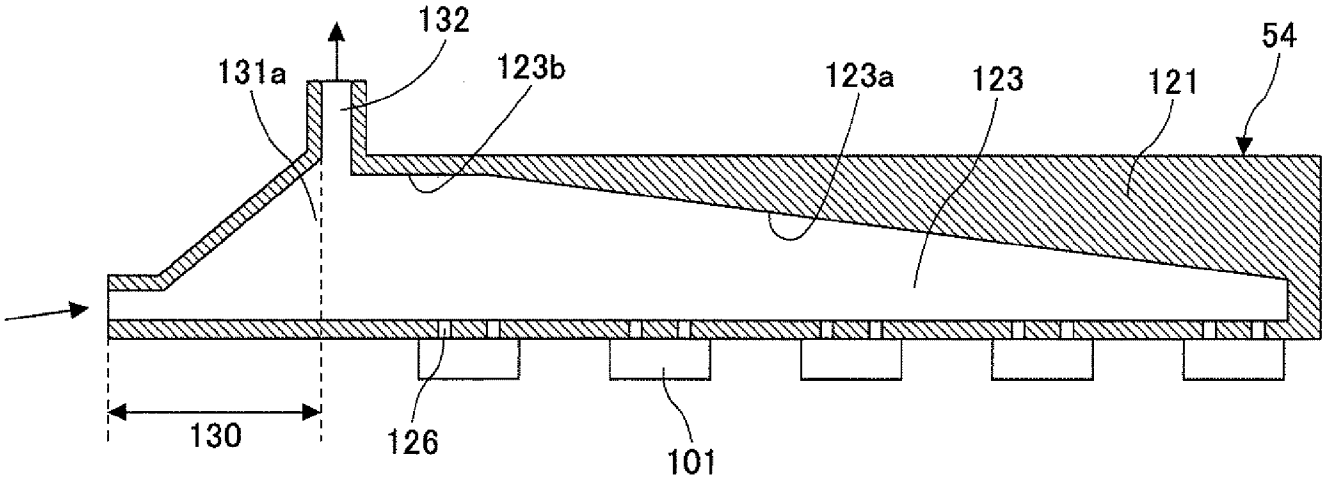
FIG. 21 is a cross section of the distributor tank according to another embodiment of the present invention.

The distributor tank 54 according to another embodiment of the present invention is described with reference to FIG. 21 illustrating a cross section of the distributor tank 54. In accordance with the present embodiment, the inlet portion 130 includes an upper sloping wall 134 that is inclined such that a cross-sectional area of the inlet portion increases gradually toward the exit 130*a* of the inlet portion. In this case, the inlet portion 130 has only a very short length of a horizontal portion and is mostly upwardly inclined, so that the bubbles can be readily guided upward along the upper sloping wall 134, while no bubbles are formed at the bottom of the inlet portion that is horizontal.

While the foregoing embodiments employ a line-type image forming apparatus, an embodiment of the present invention may employ a serial-type image forming apparatus.

Although this invention has been described in detail with reference to certain embodiments, variations and modifications exist within the scope and spirit of the invention as described and defined in the following claims.

The present application is based on Japanese Priority Applications No. 2009-197446 filed Aug. 27, 2009 and No. 2009-206305 filed Sep. 7, 2009, the entire contents of which are hereby incorporated by reference.

What is claimed is:

1. An image forming apparatus comprising:

plural heads each having a nozzle configured to discharge a droplet of a recording fluid;

a distributing member to which the plural heads are attached, the distributing member having an inlet portion, a supply channel portion, and a common fluid chamber communicated with the supply channel portion and configured to supply the recording fluid to the plural heads; and a fluid containing unit configured to supply the recording fluid to the distributing member via the inlet portion and the supply channel portion, wherein the supply channel portion includes a flow-directing wall configured to direct a flow of the recording fluid upward before the recording fluid enters the common fluid chamber, and wherein the supply channel portion includes a wall surface made of a flexible material, the image forming apparatus further comprising a resilient member configured to bias the wall surface in an outward direction.

2. The image forming apparatus according to claim 1, wherein the common fluid chamber includes an inclined portion having an inclined surface that slopes down from an exit of the inlet portion.

3. The image forming apparatus according to claim 1, wherein the inlet portion includes a sloping wall inclined such that a cross-sectional area of the inlet portion increases gradually toward an exit of the inlet portion.

4. The image forming apparatus according to claim 1, wherein the distributing member has a casing in which the common fluid chamber is formed, the plural heads are integrally formed on a base of the distributing member along a longitudinal direction of the distributing member, and wherein the common fluid chamber has an inclined top member and distributes the recording fluid along the longitudinal direction of the distributing member.

5. The image forming apparatus according to claim 1, wherein the inlet portion of the distributing member is disposed on an end of the distributing member in a longitudinal direction of the distributing member, and the recording fluid flows into the common fluid chamber through the supply channel portion from the inlet portion.

6. The image forming apparatus according to claim 1, wherein the distributing member further ncludes a bubble discharge opening formed above the supply channel portion of the distributing member.

7. The image forming apparatus according to claim 1, wherein the distributing member further includes supply openings for supplying the recording fluid to the plural heads, and the supply channel portion of the distributing member is disposed lower than the supply openings, and wherein the inlet portion of the distributing member is disposed lower than the common fluid chamber and nozzle surfaces of the plural heads.

8. The image forming apparatus according to claim 1, wherein the supply channel portion of the distributing member further includes an upper sloping wall facing the flow-directing wall, and the supply channel portion extends upward toward the common fluid chamber at an angle and with an increasing cross-sectional area.

9. The image forming apparatus according to claim 1, wherein the inlet portion of the distributing member extends upward as the inlet portion connects to the supply channel portion with an angle of inclination.

* * * * *